US008966722B2

(12) United States Patent
Ohayon

(10) Patent No.: US 8,966,722 B2
(45) Date of Patent: Mar. 3, 2015

(54) TASSEL PROTECTOR AND METHOD

(76) Inventor: Kfir Ohayon, Migdal Tefen Industrial Park (IL)

( * ) Notice: Subject to any disclaimer, the term of this patent is extended or adjusted under 35 U.S.C. 154(b) by 240 days.

(21) Appl. No.: 13/549,582

(22) Filed: Jul. 16, 2012

(65) Prior Publication Data

US 2014/0013546 A1 Jan. 16, 2014

(51) Int. Cl.
*A41D 27/08* (2006.01)

(52) U.S. Cl.
USPC ..... 24/459; 24/713.1; 24/712.4; 24/715.6; 24/715.5

(58) Field of Classification Search
CPC ..... A41D 27/12
USPC ..... 24/715.5, 488, 569, DIG. 58, DIG. 56, 24/DIG. 53, DIG. 52, 459, 713.1, 712.4, 24/715.6, 712.1, 129 A, 136 L, 714.6, 24/265 R, 265 EC, DIG. 43, DIG. 47, 24/DIG. 48, DIG. 49, 122.6, 115 R, 136 K, 24/136 R, 135 R, 713, 712, 461, 460; 28/147; 29/728, 766, 282; 206/294, 206/298, 278
See application file for complete search history.

(56) References Cited

U.S. PATENT DOCUMENTS

| | | | | |
|---|---|---|---|---|
| 1,586,473 | A * | 5/1926 | Rose | 24/713.1 |
| 4,628,630 | A * | 12/1986 | Bohme | 43/43.12 |
| 6,470,542 | B1 | 10/2002 | Giannini | |
| 8,096,024 | B2 * | 1/2012 | Smith et al. | 24/136 K |

FOREIGN PATENT DOCUMENTS

| | | |
|---|---|---|
| JP | 2005-48340 | 2/2005 |

* cited by examiner

*Primary Examiner* — Jack W Lavinder
(74) *Attorney, Agent, or Firm* — Law Offices of Steven W. Weinrieb

(57) ABSTRACT

The present invention relates to an apparatus and of a method of preserving and protecting tassels. More particularly, the present invention relates to a tassel protector accommodating at least one tassel, particularly when undergoing high wear operations, such as, but not limited to, machine laundry. The invention is concerned with an apparatus to maintain the aesthetic appearance of the tassel by placing and holding a plurality of component strands of decorative tassels into their original conditions during high wear operations.

6 Claims, 3 Drawing Sheets

TASSEL PROTECTOR AND METHOD

FIELD OF THE INVENTION

The present invention relates to an apparatus and of a method of preserving and protecting tassels. More particularly, the present invention relates to a tassel protector accommodating at least one tassel, particularly when undergoing high wear operations, such as, but not limited to, machine laundry. The invention is concerned with an apparatus to maintain the aesthetic appearance of the tassel by placing and holding a plurality of component strands of decorative tassels into their original conditions during high wear operations.

BACKGROUND OF THE INVENTION

Tassels may accompany all sorts of wear items, such as, but not limited to, garments, for decoration and/or for ceremonial purposes and/or for any other reason. High wear operation, such as laundry and/or storage, for example, may cause tassels to disarrange component strands in an unsightly manner. Heretofore, there is no effective way for users to maintain the appearance of the tassels.

Various boots have been made to overlie tassels to protect lay and order of the component strands. Tassel accessory clips are available, having a pair of overlapped, toothed jaws normally held together by spring action (spring clip design) and operable by the user for receiving the tassel between the spring-pressed jaws. It is also proposed that merely clipping the device onto an unruly tassel and leaving the receiving jaws of the clip under spring pressure over-night will "tame" the unsightly tassel. Another traditional way of straightening the tassels is by winding a rubber band over the rearranged tassels. Such a method is patently weak and ineffective.

In U.S. Pat. No. 6,470,542 to Giannini, there is disclosed, inter alia, "A method and apparatus of preserving and protecting decorative tassels after they have become unsightly from wearing of an item, or to prevent their becoming so, particularly on shoes to which they are attached. Typically, one or more tassels are made up of strands of leather or synthetic leather extending integrally side-by-side from a stem base attached to the shoe. The method and apparatus comprises of arranging or rearranging and encasing the strands in a clamcupule having an upper portion and a lower portion and snap lock mechanism with integrally molded hinge, thereby pressing the strands between the locked clamp and reviving them to or maintaining them in their original aesthetic appearance economically and conveniently".

Another prior art reference, Japanese Patent Publication JP 2005048340 to Takahashi discloses, inter alia, "to provide a storing tool for a tassel such as an obi buckle, preventing disorder of the tassel at the time of storing or carrying . . . (a) tassel storing tool has a structure of fixing the tassel such as an obi buckle through wrapping the tassel with a sheet having a part to wind and fix. The holding tool opens/closes a zipper part with light force, prevents disorder of the tassel at the time of carrying and crumples at the time of preserving, and is simple in storing."

Thus, it may be advantageous to have a tassel protector which may be easy to apply to the tassel, and to remove therefrom when not needed. Numerous other advantages and features of the present invention may become readily apparent from the following detailed description of the invention and the embodiment thereof, from the claims and from the accompanying drawings.

SUMMARY OF THE INVENTION

In The following disclosure, aspects thereof are described and illustrated in conjunction with systems and methods which are meant to be exemplary and illustrative, not limiting in scope. The present disclosure may be further directed to a method of utilization and/or usage of such apparatuses.

Accordingly, it is an object of the present invention to provide a tassel preserver specifically designed to retain or reform the tassels to their original, desired positions.

In making the present invention, it is a principal object to provide an apparatus and method whereby the repair shop or the user himself, or herself, can renew or maintain shoe tassels quickly and economically.

It is intended that the present invention will help preserve tassels during arduous use, such as during laundry.

It is also intended that the present invention to allow safe storage of the tassels so that they are not depressed or entangled over the course of time.

An aspect of the present invention generally concerns a tassel protector for protecting lay and arrangement of component strands forming the tassel during arduous use, while the tassel is attached to a garment. The tassel protector comprises a cupule and a core, with the core being removably and at least partially accommodated in the cupule. The cupule comprises an outer face and a generally parallel inner face, with the core comprising a stalk accomodatable in the cupule and extending generally co-axial therewith.

Possibly, the core comprises a knob surrounding the stalk and concentric therewith. The knob comprises an envelope having a first portion adjacent a forward end of the core and a second portion disposed generally rearwardly away therefrom with a rearwardly facing step extending between the first portion and the second portion. When the core is partially accommodated in the cupule, the step faces a lip merging the outer face and the inner face thereof.

Optionally, the knob comprises a slot formed therein. The slot may extend generally longitudinally and may open to the forward end and to the interim face and may additionally open circumferentially between a first bank and a second bank, with each of the first bank and the second bank extending generally radially inwardly away from the envelope.

Further possibly, the core may comprise a generally spiral ramp merging with and extending from the knob to merge with the rearward end while spiraling about the stalk.

Possibly, the ramp may comprise a front ramp face merging with and extending from the second bank, and a rear ramp face extending away from the first bank.

Another aspect of the present invention concerns a method of protecting lay and order of component strands of a tassel, the method comprising the steps of: providing a tassel protector comprising a core at least partially accommodatable by a removable cupule. providing the core with a knob having a slot formed therein, providing the core with a ramp spiraling away from the knob, removing the core from the cupule, inserting the tassel with the garment connected thereto through the slot so that the knob is adjacent the garment, arranging component strands along the ramp. And returning the cupule to at least partially accommodate the core.

In addition to the exemplary aspects and embodiments described above, further aspects and embodiments will become apparent by reference to the figures and by study of the following detailed descriptions.

BRIEF DESCRIPTION OF THE DRAWINGS

Exemplary and/or illustrative embodiments of the present disclosure will be presented herein below in the following figures, by way of example only. The figures are not necessarily to scale, and some features may be exaggerated or minimized and/or roughly shown and/or omitted entirely, to show details of particular components, in a purpose that the present disclosure may become more fully understood from the detailed description and the accompanying schematic figures, wherein.

DETAILED DESCRIPTION OF THE INVENTION

As required, a schematic, exemplary embodiment of the present apparatus and method are disclosed herein, however, it is to be understood that the disclosed embodiment is merely exemplary of the present disclosure, which may be embodied in various and/or alternative forms. Specific structural and functional details disclosed herein are not to be interpreted as limiting, but merely as a basis for the claims and as a representative basis for teaching one skilled in the art to variously employ the present disclosure in virtually any appropriately detailed structure.

Aspects, advantages and/or other features of example embodiments of the invention will become apparent in view of the following detailed description, which discloses various non-limiting embodiments of the invention. In describing example embodiments, specific terminology is employed for the sake of clarity. However, the embodiments are not intended to be limited to this specific terminology. It is to be understood that each specific element includes all technical equivalents that operate in a similar manner to accomplish a similar purpose.

Exemplary embodiments may be adapted for many different purposes and are not intended to be limited to the specific exemplary purposes set forth herein. Other non-limiting examples of such embodiments are compositions that may be used, for example, for structural components. Those skilled in the art would be able to adapt the embodiments of the present disclosure, depending for example, on the intended use of the embodiment.

Figure 1:
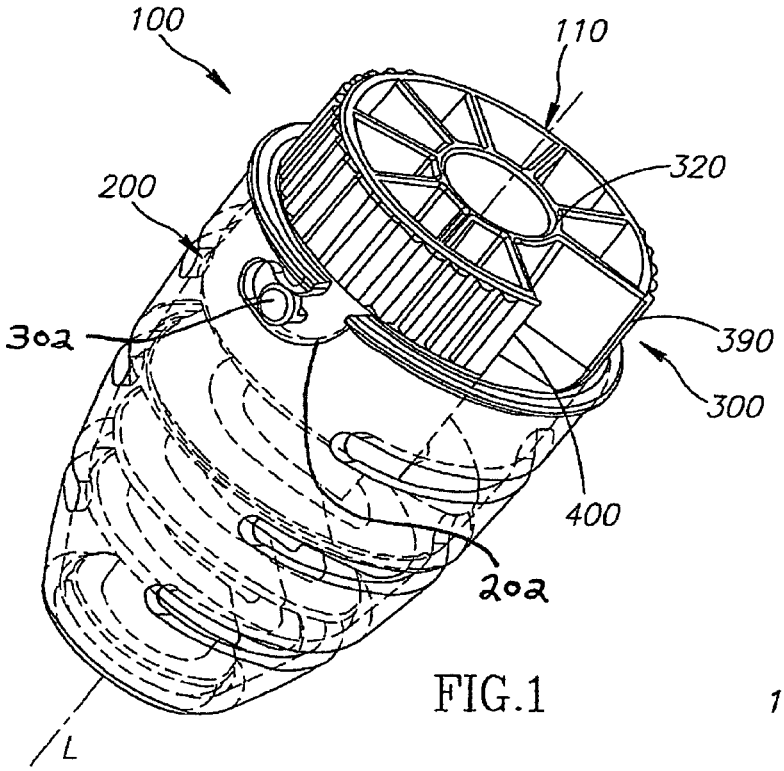
FIG. 1 shows a schematic perspective view of an exemplary embodiment of a tassel protector according to the present invention in a closed position.
Figure 2:
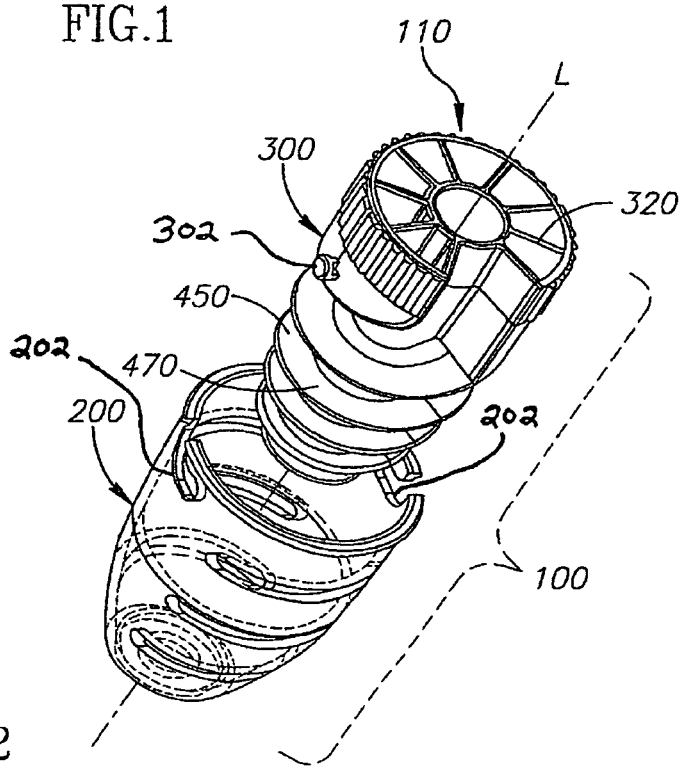
FIG. 2 shows a schematic exploded perspective view of the exemplary embodiment of the tassel protector shown on FIG. 1.
Figure 5:
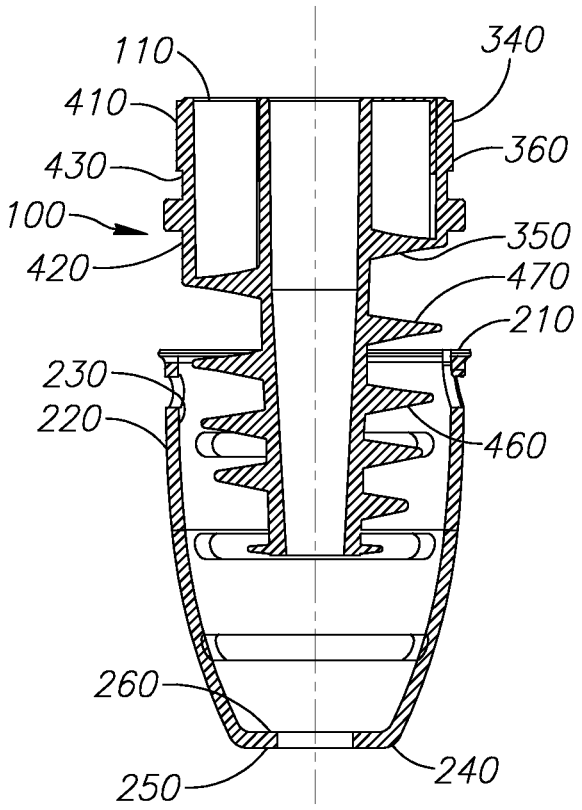
FIG. 5 shows a schematic axial cross-section view of the exemplary embodiment of the tassel protector shown on FIG. 1.

Attention is presently directed to FIGS. 1, 2 and 5. In FIG. 1, a tassel protect- or 100 is shown with a front 110 at the upper right corner of the illustration, and in FIG. 2, the front 110 is also shown at the upper right corner of the illustration. The tassel protector 100 comprises a cupule 200 and a core 300 wherein the core 300 is at least partially nested within the generally cup-shaped cupule 200. When at least partially nesting in the cupule 200, the core 300 is aligned generally coaxial with the cupule 200 along a longitudinal axis L. The tassel protector 100 extends generally longitudinally away from the front 110, thereby defining a front-to-rear direction. A pair of diametrically opposed lugs 302, only one of which is visible, are provided upon external side wall portions of the core 300 and a pair of diametrically opposed substantially L-shaped slots 202 are formed within side wall portions of the cupule 200 such that when the core 300 is inserted into the cupule 200, and subsequently rotated with respect to the cupule 200, the lugs 302 will be disposed within the slots 202 so as to effectively lock the core 300 within the cupule 200.

Figure 3:
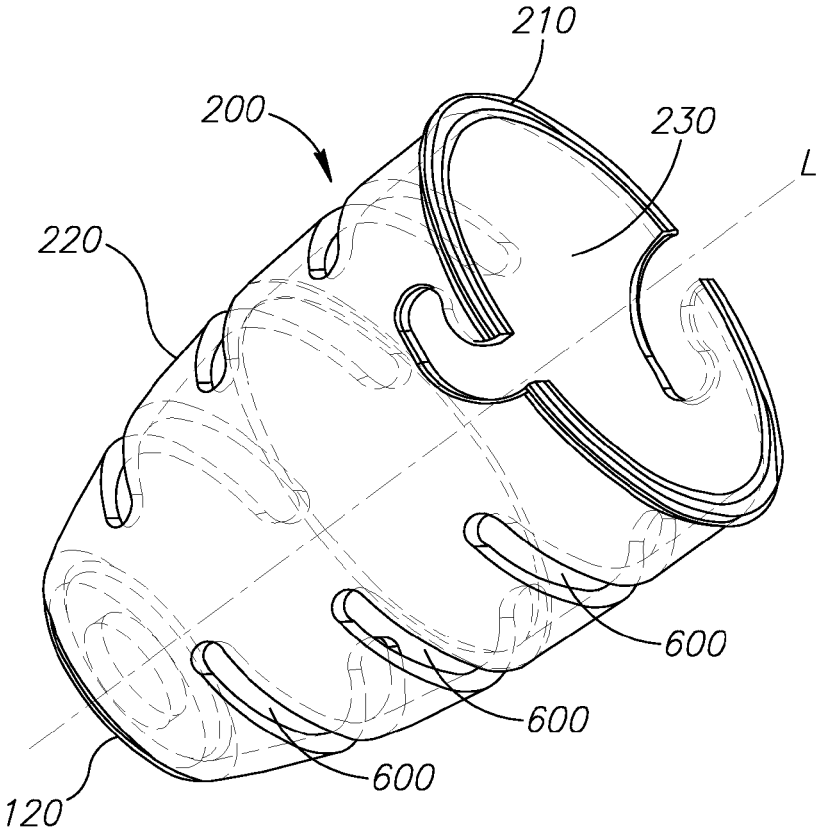
FIG. 3 shows a schematic perspective view of an exemplary cupule of the tassel protector shown on FIG. 1.

Attention is additionally drawn to FIG. 3. The cupule 200 extends generally longitudinally rearwardly away from a lip 210 adjacent the front 110 of the tassel protector 100. The cupule 200 further comprises oppositely disposed and generally parallel or concentric outer and inner faces 220,230. The outer face 220 and the inner face 230 merge at the lip 210 and extend generally axially away therefrom so as to terminate at an end structure 240. As can best be seen from FIG. 5, the end structure 240 comprises oppositely disposed and generally parallel outer and inner end portions 250,260. The outer end 250 merges with the outer face 220 while the inner end 260 merges with the inner face 230. The outer end 250 and the inner end 260 extend generally transversely to the longitudinal axis L. The outer end 250 defines a rear portion 120 of the tassel protector 100.

Figure 4:
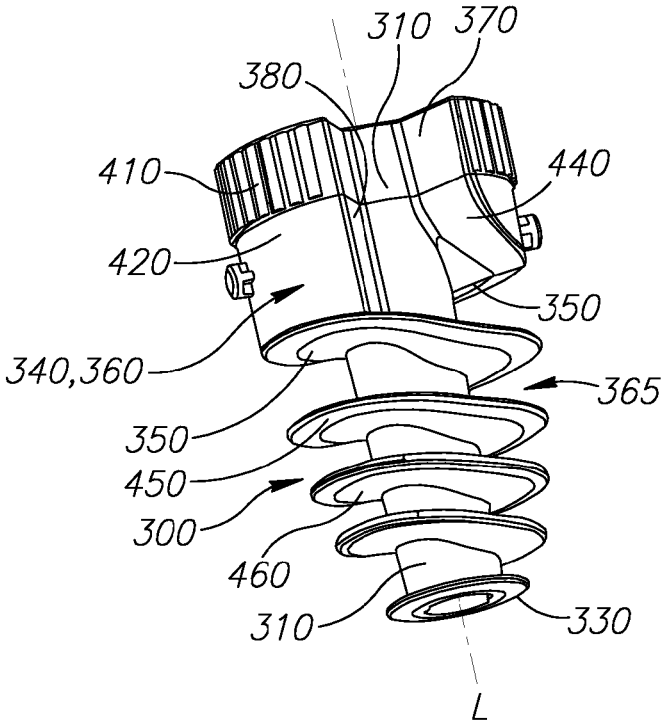
FIG. 4 shows a schematic perspective view of an exemplary core of the tassel protector shown on FIG. 1.

Attention is now drawn to FIG. 4. The core 300 comprises a stalk 310 which extends in a rearward direction away from a forward end 320 of the core 300, adjacent the front 110 of the tassel protector 100, as can be appreciated from FIG. 1, so as to terminate at a rear end 330. The stalk 300 is partially surrounded by a generally cylindrical knob 340. The knob 340 extends generally rearwardly from the forward end 320 of the core 300, annularly surrounds the stalk 310, and terminates at a generally rearwardly-facing, radially outwardly extending face 350 as can best be appreciated from FIG. 5. The knob 340 extends generally radially away from the stalk 310 and coaxially therewith to a radially-outermost envelope or peripheral surface portion 360. The envelope or peripheral surface portion 360 comprises a slot 365 which extends generally longitudinally between the forward end 320 of the core 300 and the face 350. The slot 365 also extends substantially in a partially circumferential manner from a first bank 370 to a second bank 380 of the knob 340. Both the first bank 370 and the second bank 380 extend generally longitudinally from the forward end 320 of the core 300 toward the face 350. In addition, both the first bank 370 and the second bank 380 effectively extend radially inwardly from the outer envelope or peripheral surface portion 360 to the stalk 310 so as to merge therewith. The first bank 370 meets the envelope 360 at a first corner 390, while the second bank 380 meets the envelope 360 at a second corner 400, as can best be appreciated from FIG. 1.

The envelope 360 also comprises a first portion 410 adjacent the forward end 320 and a second portion 420 adjacent the interim face 350 as can best be appreciated from FIGS. 4 and 5, and an annular step 430 is defined between the first portion 410 and the second portion 420. The first bank 370 extends to an inclined transition 440 which then extends to and merges with the radially outwardly extending face 350. The face 350 extends circumferentially from the transition 440 to a diametrically opposite ramp face 460 of a generally spiral ramp 450 which can be seen in FIG. 2. The second bank 380 extends to and merges with a front ramp face 470 disposed generally opposite the rear ramp face 460 of the spiral ramp 450. The ramp spiral 450 spirals about the stalk 310 and joins therewith, extending generally rearwardly so as to terminate with the rear ramp face 460 merging with the rearward end 330 of the core 300.

Figure 6:
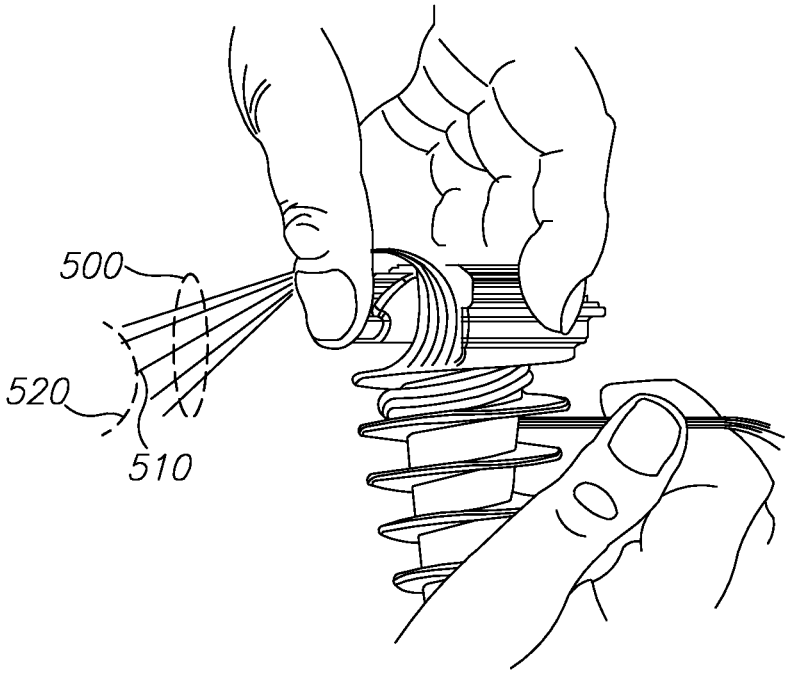
FIG. 6 shows a schematic wrapping of an illustrative tassel about the exemplary core of the tassel protector shown on FIG. 1.

Attention is now directed toward FIG. 6. As a tassel 500, having generally convergent and/or parallel component strands 510, needs to be protected during high-intensity use, the tassel 500 is threaded onto the core 300. The tassel 500 is positioned with a garment end (not shown) of a garment (not shown), to which the tassel 500 may be connected, disposed adjacent the forward end 320 of the core 300. The tassel 500 is inserted between the first bank 370 and the second bank 380 and is further wrapped about the stalk 310 as it is guided between the rear ramp face 460 and the front ramp face 470. Once the tassel 500 is wrapped about the core 300, the cupule 200 is placed over the core 300, and the tassel 500 wrapped thereabout, so as to protect the individual tassel components 510 and safeguard their disposition, orientation, and neatness. When the core 300 is fully inserted into the cupule 200, the lip 210 of the cupule 200 is disposed axially adjacent to the step 430 of the core 300 such that the second portion 420 is disposed or accommodated within the cupule 200 and faces the inner face 230, while the first portion 410 is external of the cupule 200. The cupule 200 may have a plurality of circumferentially extending or oriented slots 600 interlinking its inner face 230 and its outer face 220.

In view of the foregoing, it shall be evident that the present invention provides a unique system that protects the disposition, orientation, and neatness of the individual strands of a tassel in a simple, convenient and easy manner. Besides, the present invention is especially useful for easily protecting the tassel against the occurrence of increased wear while facilitating using a garment with its tassels unhindered.

All directional references (that is, upper, lower, upward, downward, left, right, leftward, rightward, top, bottom, above, below, vertical, horizontal, clockwise, and counterclockwise) are only used for identification purposes to aid the reader's understanding of the present disclosure, and may not create limitations, particularly as to the position, orientation, or use of the apparatus and/or method disclosed herein. Joinder references (that is, attached, coupled, connected, hinged, and the like) are to be construed broadly and may include intermediate members between a connection of elements and relative movement between elements. As such, joinder references do not necessarily infer that two elements are directly connected and in fixed relation to each other.

Additionally, all numerical terms, such as, but not limited to, "first", "second", "third", or any other ordinary and/or numerical terms, should also be taken only as identifiers, to assist the reader's understanding of the various embodiments, variations and/or modifications of the present disclosure, and may not create any limitations, particularly as to the order, or preference, of any embodiment, variation and/or modification relative to, or over, another embodiment, variation and/or modification.

Similarly, adjectives such as, but not limited to, "articulated", "modified", or similar, should be construed broadly, and only as nominal, and may not create any limitations, not create any limitations, particularly as to the description, operation, or use unless specifically set forth in the claims.

In methodologies directly or indirectly set forth herein, various steps and operations are described in one possible order of operation, but those skilled in the art will recognize that steps and operations may be rearranged, replaced, or eliminated without necessarily departing from the spirit and scope of the present disclosure as set forth in the claims. It is intended that all matter contained in the above description or shown in the accompanying drawings shall be interpreted as illustrative only and not limiting. Changes in detail or structure may be made without departing from the spirit of the present disclosure as defined in the appended claims.

While certain exemplary embodiments have been described and shown in the accompanying drawings, it is to be understood that such embodiments are merely illustrative of and not restrictive on the broad present disclosure, and that this present disclosure not be limited to the specific constructions and arrangements shown and described, since various other modifications and/or adaptations may occur to those of ordinary skill in the art. It is to be understood that individual features shown or described for one embodiment may be combined with individual features shown or described for another embodiment. It is to be understood some features are shown or described to illustrate the use of the present disclosure in the context of functional elements and such features may be omitted within the scope of the present disclosure and without departing from the spirit of the present disclosure as defined in the appended claims.

The invention claimed is:

1. A tassel protector for protecting an arrangement of component strands forming a tassel, comprising:

a cupule;

a core removably and at least partially accommodated within said cupule, said cupule comprising a substantially hollow body;

said core comprising a stalk accommodatable within said cupule, extending generally coaxially therewith, and comprising a plurality of spiral sections, axially spaced from each other so as to form axial spaces between successive ones of said plurality of spiral sections, and forming a single continuous spiral integrally formed with and around said stalk, such that when the tassel is wrapped around said stalk and disposed within said axial spaces defined between said plurality of axially spaced spiral sections, the tassel is protected within said core when said core is inserted into said cupule;

at least one lug projecting outwardly from an external side wall portion of said core; and at least one slot defined within a side wall portion of said cupule for reception of said lug of said core such that when said core is inserted into said cupule and rotated with respect to said cupule, said core will effectively be locked within said cupule.

2. The tassel protector of claim 1, wherein:

said core comprises a knob surrounding the stalk and concentric therewith, the knob comprises an envelope having a first portion adjacent a forward end of said core and a second portion disposed generally rearwardly away therefrom with a rearwardly facing step extending between said first portion and said second portion, and wherein when partially accommodated within said cupule, said step engages a lip disposed upon an upper surface portion of said cupule.

3. The tassel protector of claim 2, wherein:

said knob comprises a slot formed therein and extending generally longitudinally and opening to the forward end and the interim face and circumferentially between a first bank and a second bank, with each of the first bank and the second bank extending generally radially inwardly away from the envelope.

4. The tassel protector of claim 3, wherein said spiral ramp merges with and extends from the knob so as to merge with a rearward end of said core while spiraling about the stalk.

5. The tassel protector of claim 4 wherein the spiral ramp comprises a front ramp face merging with and extending from the second bank, and a rear ramp face extending away from the first bank.

6. A method of protecting lay and order of component strands of a tassel, the method comprising steps of:

providing a tassel protector comprising a core at least partially accommodatable by a removable cupule;

providing the core with a knob having a slot formed therein;

providing the core with a ramp spiraling away from the knob;

removing the core from the cupule;

inserting the tassel with the garment connected thereto through the slot so that the knob is adjacent the garment;

arranging component strands along the ramp; and returning the cupule to at least partially accommodate the core.

* * * * *